US010473373B2

(12) United States Patent
Hancock

(10) Patent No.: US 10,473,373 B2
(45) Date of Patent: Nov. 12, 2019

(54) MANIFOLD SIGHTGLASS FOR CHARGING MICROCHANNEL SYSTEM

(71) Applicant: TRANE INTERNATIONAL INC., Davidson, NC (US)

(72) Inventor: Stephen S. Hancock, Flint, TX (US)

(73) Assignee: TRANE INTERNATIONAL INC., Davidson, NC (US)

( * ) Notice: Subject to any disclaimer, the term of this patent is extended or adjusted under 35 U.S.C. 154(b) by 10 days.

(21) Appl. No.: 15/664,984

(22) Filed: Jul. 31, 2017

(65) Prior Publication Data

US 2019/0032975 A1 Jan. 31, 2019

(51) Int. Cl.

| | |
|---|---|
| ***F25B 45/00*** | (2006.01) |
| ***F24F 1/14*** | (2011.01) |
| ***F25B 39/00*** | (2006.01) |
| ***F25B 49/02*** | (2006.01) |
| ***F25B 39/04*** | (2006.01) |
| ***F25B 41/00*** | (2006.01) |
| ***F28F 9/02*** | (2006.01) |
| ***F28D 1/053*** | (2006.01) |
| ***F28F 1/02*** | (2006.01) |
| *F25B 13/00* | (2006.01) |
| *F28D 21/00* | (2006.01) |

(52) U.S. Cl.

CPC ..... *F25B 45/00* (2013.01); *F24F 1/14* (2013.01); *F25B 39/00* (2013.01); *F25B 39/04* (2013.01); *F25B 41/006* (2013.01); *F25B 49/02* (2013.01); *F28D 1/05391* (2013.01); *F28F 1/022* (2013.01); *F28F 9/0209* (2013.01); *F25B 13/00* (2013.01); *F25B 2345/001* (2013.01); *F25B 2500/23* (2013.01); *F25B 2500/24* (2013.01); *F28D 2021/0068* (2013.01); *F28F 2260/02* (2013.01)

(58) Field of Classification Search

CPC ..... F28D 1/05391; F28D 1/05383; F28D 1/05375; F28F 1/00; F25B 45/00; F25B 39/00; F25B 2345/001; F24F 1/14

See application file for complete search history.

(56) References Cited

U.S. PATENT DOCUMENTS

| | | | | |
|---|---|---|---|---|
| 6,397,627 | B1 * | 6/2002 | Aki | F25B 39/04 62/509 |
| 2005/0008551 | A1 * | 1/2005 | McKay | F24H 1/0045 422/198 |
| 2013/0255294 | A1 * | 10/2013 | Crawford | F25B 45/00 62/126 |
| 2015/0192371 | A1 * | 7/2015 | Hancock | F28F 1/126 165/173 |

* cited by examiner

*Primary Examiner* — Emmanuel E Duke

(74) *Attorney, Agent, or Firm* — Hamre, Schumann, Mueller & Larson, P.C.

(57) ABSTRACT

A microchannel heat exchanger has an upper portion connected in fluid communication with a header, a lower portion connected in fluid communication with the header at a location that is vertically lower on the header than the upper portion, and a sight glass on the header. The sight glass can be horizontally aligned with a top of the second portion. The sight glass can be served as a visual aid when charging the microchannel heat exchanger with a refrigerant at a predetermined level. When an indicator indicates that refrigerant is mixed vapor and liquid, refrigerant can be added into the microchannel heat exchanger. When the indicator indicates that the refrigerant is liquid, the charging process can be stopped.

4 Claims, 9 Drawing Sheets

MANIFOLD SIGHTGLASS FOR CHARGING MICROCHANNEL SYSTEM

FIELD

This disclosure relates generally to heat exchangers in a heating, ventilation, and air conditioning (HVAC) system. More specifically, the disclosure relates to methods and systems for identifying a charge level of a microchannel heat exchanger in an HVAC system.

BACKGROUND

Heating, ventilation, and/or air conditioning (HVAC) systems may generally be used in residential and/or commercial structures to provide heating and/or cooling to climate-controlled areas within these structures. Some HVAC systems may comprise a microchannel heat exchanger. However, because a microchannel heat exchanger may comprise a two-phase refrigerant volume that may be less than 1% of the volume of a conventional heat exchanger, microchannel heat exchangers remain sensitive to liquid refrigerant volume, which can change due to inaccuracies in charging the unit with refrigerant and/or during changes in operating conditions that may cause the refrigerant to change phases and/or any liquid refrigerant to change density. In some cases, liquid refrigerant may displace two-phase refrigerant within the microchannel heat exchanger and thereby significantly degrading the performance of the microchannel heat exchanger as compared to the performance of the microchannel heat exchanger when two-phase refrigerant occupies the space.

SUMMARY

In some embodiments of the disclosure, a microchannel heat exchanger is disclosed as comprising a first portion connected in fluid communication with an undivided header, and a second portion connected in fluid communication with the undivided header at a location that is vertically lower on the undivided header than the first portion, wherein ratio of the first portion to the second portion is greater than 2:1.

In other embodiments of the disclosure, a method of operating a microchannel heat exchanger is disclosed as comprising: providing a microchannel heat exchanger in an HVAC system, the microchannel heat exchanger comprising an upper portion connected in fluid communication with an undivided header, and a lower portion connected in fluid communication with the undivided header at a location that is vertically lower on the undivided header than the upper portion, wherein the ratio of the upper portion to the lower portion is greater than 2:1; introducing a refrigerant into the upper portion; under normal steady state operating conditions, condensing a first amount of liquid phase refrigerant in the upper portion, wherein the first volume of liquid phase refrigerant substantially fills the lower portion, and wherein substantially none of the refrigerant is condensed into liquid phase refrigerant in the lower portion; and under abnormal steady state operating conditions, condensing a second amount of liquid phase refrigerant in the upper portion, wherein an additional amount of the second amount of liquid phase refrigerant in excess of the first amount of liquid phase refrigerant is received in the undivided header.

In some embodiments of the disclosure, a microchannel heat exchanger is disclosed as comprising a first portion connected in fluid communication with a header, a second portion connected in fluid communication with the header at a location that is vertically lower on the header than the first portion, and a sight glass on the header for identifying a charge level of the microchannel heat exchanger.

In some embodiments of the disclosure, a method of charging a microchannel heat exchanger is disclosed as comprising providing a microchannel heat exchanger in an HVAC system. The microchannel heat exchanger comprises an upper portion connected in fluid communication with a header, a lower portion connected in fluid communication with the header at a location that is vertically lower on the header than the upper portion, and a sight glass on the header for identifying a charge level of the microchannel heat exchanger. The method further comprises introducing a refrigerant into the microchannel heat exchanger. The refrigerant is accommodated in the header. The method also comprises charging the microchannel heat exchanger with the refrigerant to a predetermined level.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTIONS

In some cases, it may be desirable to provide a charge tolerant microchannel heat exchanger for an HVAC system. For example, where abnormal steady state operating conditions and/or overcharging of the HVAC system may cause liquid refrigerant to occupy a portion of a heat exchanger optimized for transferring heat with gaseous or mixed phase refrigerant, it may be desirable to provide a charge tolerant microchannel heat exchanger for an HVAC system that may provide an increase in efficiency when operating in an overcharged state and/or under normal or abnormal steady state operating conditions. In some embodiments, systems and methods are disclosed that comprise providing a charge tolerant microchannel heat exchanger that comprises an undivided header that is configured to receive excess liquid refrigerant to maintain and/or increase the efficiency of the charge tolerant microchannel heat exchanger. In some embodiments, the charge tolerant microchannel heat exchanger may be used in an HVAC system, including, but not limited to, a heat pump system.

An HVAC system (for example, a split HVAC system that includes an outdoor unit and an indoor unit, etc.) with an active expansion device can be charged by adding or removing a refrigerant until a specified level of subcooling is attained. An active expansion device is an expansion device, for example, having an orifice(s) with a controllable size/diameter. An HVAC system (for example, a split HVAC system) with a passive expansion device can be charged until a specified level of superheat is attained. A passive expansion device is an expansion device, for example, having an orifice(s) with a fixed size/diameter. Active expansion devices may be more commonly used due to higher efficiencies of the systems relative to passive expansion devices. Charging an HVAC system with a microchannel heat exchanger may be difficult because subcooling can be sensitive to a volume of the refrigerant. A microchannel heat exchanger, as used in this specification, has a plurality of flat tubes with fins located between the flat tubes extending between a plurality of headers. An excess liquid refrigerant volume may undesirably cause higher subcooling and/or higher compressor discharge pressures.

Figure 1:
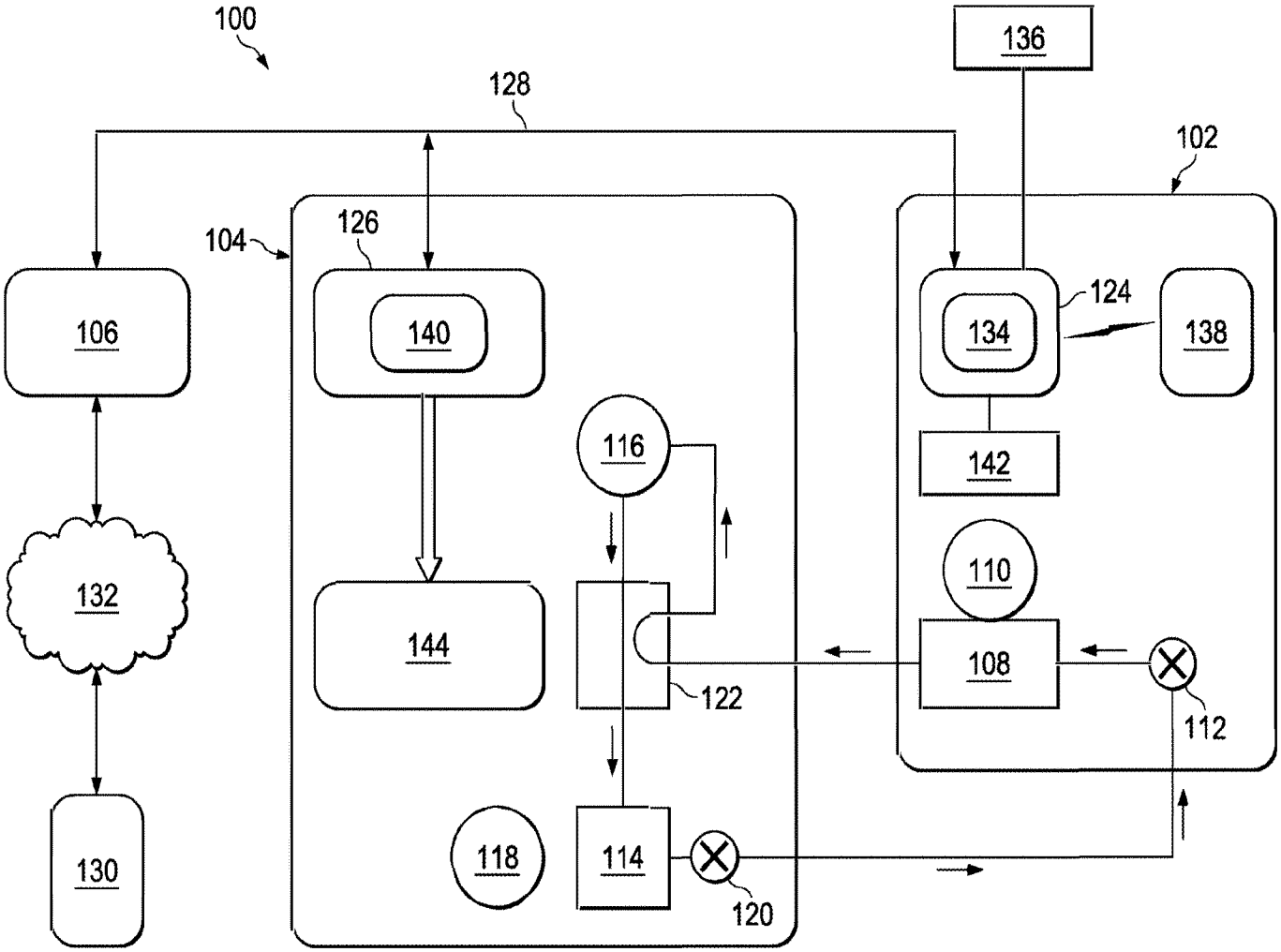
FIG. 1 is a simplified schematic diagram of an HVAC system according to an embodiment of the disclosure.

Referring now to FIG. 1, a simplified schematic diagram of an HVAC system 100 is shown according to an embodiment of the disclosure. HVAC system 100 generally comprises an indoor unit 102, an outdoor unit 104, and a system controller 106. The system controller 106 may generally control operation of the indoor unit 102 and/or the outdoor unit 104. As shown, the HVAC system 100 is a so-called heat pump system that may be selectively operated to implement one or more substantially closed thermodynamic refrigeration cycles to provide a cooling functionality and/or a heating functionality.

Indoor unit 102 generally comprises an indoor heat exchanger 108, an indoor fan 110, and an indoor metering device 112. Indoor heat exchanger 108 is a plate fin heat exchanger configured to allow heat exchange between refrigerant carried within internal tubing of the indoor heat exchanger 108 and fluids that contact the indoor heat exchanger 108 but that are kept segregated from the refrigerant. In other embodiments, indoor heat exchanger 108 may comprise a spine fin heat exchanger, a microchannel heat exchanger, or any other suitable type of heat exchanger.

The indoor fan 110 is a centrifugal blower comprising a blower housing, a blower impeller at least partially disposed within the blower housing, and a blower motor configured to selectively rotate the blower impeller. In other embodiments, the indoor fan 110 may comprise a mixed-flow fan and/or any other suitable type of fan. The indoor fan 110 is configured as a modulating and/or variable speed fan capable of being operated at many speeds over one or more ranges of speeds. In other embodiments, the indoor fan 110 may be configured as a multiple speed fan capable of being operated at a plurality of operating speeds by selectively electrically powering different ones of multiple electromagnetic windings of a motor of the indoor fan 110. In yet other embodiments, the indoor fan 110 may be a single speed fan.

The indoor metering device 112 is an electronically controlled motor driven electronic expansion valve (EEV). In alternative embodiments, the indoor metering device 112 may comprise a thermostatic expansion valve, a capillary tube assembly, and/or any other suitable metering device. The indoor metering device 112 may comprise and/or be associated with a refrigerant check valve and/or refrigerant bypass for use when a direction of refrigerant flow through the indoor metering device 112 is such that the indoor metering device 112 is not intended to meter or otherwise substantially restrict flow of the refrigerant through the indoor metering device 112.

Outdoor unit 104 generally comprises an outdoor heat exchanger 114, a compressor 116, an outdoor fan 118, an outdoor metering device 120, and a reversing valve 122. Outdoor heat exchanger 114 is a microchannel heat exchanger configured to allow heat exchange between refrigerant carried within internal passages of the outdoor heat exchanger 114 and fluids that contact the outdoor heat exchanger 114 but that are kept segregated from the refrigerant. In other embodiments, outdoor heat exchanger 114 may comprise a plate fin heat exchanger, a spine fin heat exchanger, or any other suitable type of heat exchanger.

The compressor 116 is a multiple speed scroll type compressor configured to selectively pump refrigerant at a plurality of mass flow rates. In alternative embodiments, the compressor 116 may comprise a modulating compressor capable of operation over one or more speed ranges, a reciprocating type compressor, a single speed compressor, and/or any other suitable refrigerant compressor and/or refrigerant pump.

The outdoor fan 118 is an axial fan comprising a fan blade assembly and fan motor configured to selectively rotate the fan blade assembly. In other embodiments, the outdoor fan 118 may comprise a mixed-flow fan, a centrifugal blower, and/or any other suitable type of fan and/or blower. The outdoor fan 118 is configured as a modulating and/or variable speed fan capable of being operated at many speeds over one or more ranges of speeds. In other embodiments, the outdoor fan 118 may be configured as a multiple speed fan capable of being operated at a plurality of operating speeds by selectively electrically powering different ones of multiple electromagnetic windings of a motor of the outdoor fan 118. In yet other embodiments, the outdoor fan 118 may be a single speed fan.

The outdoor metering device 120 is a thermostatic expansion valve. In alternative embodiments, the outdoor metering device 120 may comprise an electronically controlled motor driven EEV similar to indoor metering device 112, a capillary tube assembly, and/or any other suitable metering device. The outdoor metering device 120 may comprise and/or be associated with a refrigerant check valve and/or refrigerant bypass for use when a direction of refrigerant flow through the outdoor metering device 120 is such that the outdoor metering device 120 is not intended to meter or otherwise substantially restrict flow of the refrigerant through the outdoor metering device 120.

The reversing valve 122 is a so-called four-way reversing valve. The reversing valve 122 may be selectively controlled to alter a flow path of refrigerant in the HVAC system 100 as described in greater detail below. The reversing valve 122 may comprise an electrical solenoid or other device configured to selectively move a component of the reversing valve 122 between operational positions.

The system controller 106 may generally comprise a touchscreen interface for displaying information and for receiving user inputs. The system controller 106 may display information related to the operation of the HVAC system 100 and may receive user inputs related to operation of the HVAC system 100. However, the system controller 106 may further be operable to display information and receive user inputs tangentially and/or unrelated to operation of the HVAC system 100. In some embodiments, the system controller 106 may not comprise a display and may derive all information from inputs from remote sensors and remote configuration tools. In some embodiments, the system controller 106 may comprise a temperature sensor and may further be configured to control heating and/or cooling of zones associated with the HVAC system 100. In some embodiments, the system controller 106 may be configured as a thermostat for controlling supply of conditioned air to zones associated with the HVAC system 100.

In some embodiments, the system controller 106 may also selectively communicate with an indoor controller 124 of the indoor unit 102, with an outdoor controller 126 of the outdoor unit 104, and/or with other components of the HVAC system 100. In some embodiments, the system controller 106 may be configured for selective bidirectional communication over a communication bus 128. In some embodiments, portions of the communication bus 128 may comprise a three-wire connection suitable for communicating messages between the system controller 106 and one or more of the HVAC system 100 components configured for interfacing with the communication bus 128. Still further, the system controller 106 may be configured to selectively communicate with HVAC system 100 components and/or any other device 130 via a communication network 132. In some embodiments, the communication network 132 may comprise a telephone network, and the other device 130 may comprise a telephone. In some embodiments, the communication network 132 may comprise the Internet, and the other device 130 may comprise a smartphone and/or other Internet-enabled mobile telecommunication device. In other embodiments, the communication network 132 may also comprise a remote server.

The indoor controller 124 may be carried by the indoor unit 102 and may be configured to receive information inputs, transmit information outputs, and otherwise communicate with the system controller 106, the outdoor controller 126, and/or any other device 130 via the communication bus 128 and/or any other suitable medium of communication. In some embodiments, the indoor controller 124 may be configured to communicate with an indoor personality module 134 that may comprise information related to the identification and/or operation of the indoor unit 102. In some embodiments, the indoor controller 124 may be configured to receive information related to a speed of the indoor fan 110, transmit a control output to an electric heat relay, transmit information regarding an indoor fan 110 volumetric flow-rate, communicate with and/or otherwise affect control over an air cleaner 136, and communicate with an indoor EEV controller 138. In some embodiments, the indoor controller 124 may be configured to communicate with an indoor fan controller 142 and/or otherwise affect control over operation of the indoor fan 110. In some embodiments, the indoor personality module 134 may comprise information related to the identification and/or operation of the indoor unit 102 and/or a position of the outdoor metering device 120.

In some embodiments, the indoor EEV controller 138 may be configured to receive information regarding temperatures and/or pressures of the refrigerant in the indoor unit 102. More specifically, the indoor EEV controller 138 may be configured to receive information regarding temperatures and pressures of refrigerant entering, exiting, and/or within the indoor heat exchanger 108. Further, the indoor EEV controller 138 may be configured to communicate with the indoor metering device 112 and/or otherwise affect control over the indoor metering device 112. The indoor EEV controller 138 may also be configured to communicate with the outdoor metering device 120 and/or otherwise affect control over the outdoor metering device 120.

The outdoor controller 126 may be carried by the outdoor unit 104 and may be configured to receive information inputs, transmit information outputs, and otherwise communicate with the system controller 106, the indoor controller 124, and/or any other device via the communication bus 128 and/or any other suitable medium of communication. In some embodiments, the outdoor controller 126 may be configured to communicate with an outdoor personality module 140 that may comprise information related to the identification and/or operation of the outdoor unit 104. In some embodiments, the outdoor controller 126 may be configured to receive information related to an ambient temperature associated with the outdoor unit 104, information related to a temperature of the outdoor heat exchanger 114, and/or information related to refrigerant temperatures and/or pressures of refrigerant entering, exiting, and/or within the outdoor heat exchanger 114 and/or the compressor 116. In some embodiments, the outdoor controller 126 may be configured to transmit information related to monitoring, communicating with, and/or otherwise affecting control over the outdoor fan 118, a compressor sump heater, a solenoid of the reversing valve 122, a relay associated with adjusting and/or monitoring a refrigerant charge of the HVAC system 100, a position of the indoor metering device 112, and/or a position of the outdoor metering device 120. The outdoor controller 126 may further be configured to communicate with a compressor drive controller 144 that is configured to electrically power and/or control the compressor 116.

The HVAC system 100 is shown configured for operating in a so-called cooling mode in which heat is absorbed by refrigerant at the indoor heat exchanger 108 and heat is rejected from the refrigerant at the outdoor heat exchanger 114. In some embodiments, the compressor 116 may be operated to compress refrigerant and pump the relatively high temperature and high pressure compressed refrigerant from the compressor 116 to the outdoor heat exchanger 114 through the reversing valve 122 and to the outdoor heat exchanger 114. As the refrigerant is passed through the outdoor heat exchanger 114, the outdoor fan 118 may be operated to move air into contact with the outdoor heat exchanger 114, thereby transferring heat from the refrigerant to the air surrounding the outdoor heat exchanger 114. The refrigerant may primarily comprise liquid phase refrigerant and the refrigerant may flow from the outdoor heat exchanger 114 to the indoor metering device 112 through and/or around the outdoor metering device 120 which does not substantially impede flow of the refrigerant in the cooling mode. The indoor metering device 112 may meter passage of the refrigerant through the indoor metering device 112 so that the refrigerant downstream of the indoor metering device 112 is at a lower pressure than the refrigerant upstream of the indoor metering device 112. The pressure differential across the indoor metering device 112 allows the refrigerant downstream of the indoor metering device 112 to expand and/or at least partially convert to a two-phase (vapor and gas) mixture. The two phase refrigerant may enter the indoor heat exchanger 108. As the refrigerant is passed through the indoor heat exchanger 108, the indoor fan 110 may be operated to move air into contact with the indoor heat exchanger 108, thereby transferring heat to the refrigerant from the air surrounding the indoor heat exchanger 108, and causing evaporation of the liquid portion of the two phase mixture. The refrigerant may thereafter re-enter the compressor 116 after passing through the reversing valve 122.

To operate the HVAC system 100 in the so-called heating mode, the reversing valve 122 may be controlled to alter the flow path of the refrigerant, the indoor metering device 112 may be disabled and/or bypassed, and the outdoor metering device 120 may be enabled. In the heating mode, refrigerant may flow from the compressor 116 to the indoor heat exchanger 108 through the reversing valve 122, the refrigerant may be substantially unaffected by the indoor metering device 112, the refrigerant may experience a pressure differential across the outdoor metering device 120, the refrigerant may pass through the outdoor heat exchanger 114, and the refrigerant may reenter the compressor 116 after passing through the reversing valve 122. Most generally, operation of the HVAC system 100 in the heating mode reverses the roles of the indoor heat exchanger 108 and the outdoor heat exchanger 114 as compared to their operation in the cooling mode.

Figure 2:
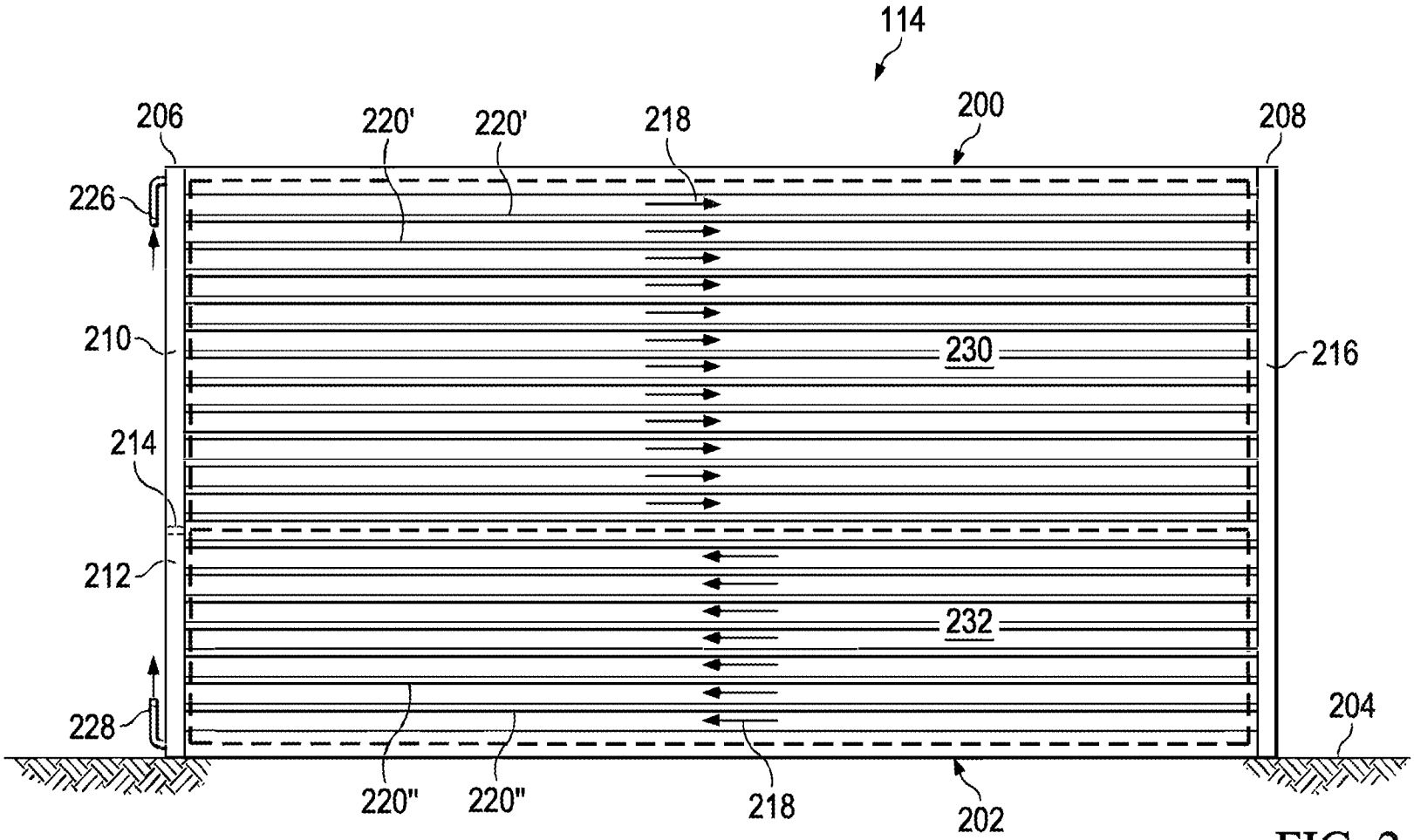
FIG. 2 is an orthogonal front view of an outdoor heat exchanger according to an embodiment of the disclosure.

Referring now to FIG. 2, a simplified orthogonal front view of outdoor heat exchanger 114 of HVAC system 100 is shown according to an embodiment of the disclosure. While the outdoor heat exchanger 114 is shown in an unbent configuration, the outdoor heat exchanger 114 may alternatively be bent into a C-shape, U-shape, circular shape, and/or any other suitable configuration to complement the remainder of an outdoor unit. The outdoor heat exchanger 114 generally comprises an upper end 200 and a lower end 202. The lower end 202 may generally be located vertically lower than the upper end 200, and in some embodiments, the lower end 202 may be located in close proximity to a support surface 204 that may generally support the outdoor unit 104 of FIG. 1.

The outdoor heat exchanger 114 may also comprise a divided header 206 and an undivided header 208. The divided header 206 may generally comprise a tubular structure that comprises an upper volume 210 and a lower volume 212. The upper volume 210 and the lower volume 212 may generally be separated and prevented from directly communicating fluid between each other by a divider 214 disposed within the divided header 206 between the upper volume 210 and the lower volume 212. In some embodiments, the divided header 206 may be replaced by two physically separate headers, the upper header comprising the upper volume 210 and the lower header comprising the lower volume 212. The undivided header 208 may generally comprise a substantially similar tubular structure to that of the divided header 206. However, the undivided header 208 does not comprise an internal structure analogous to the divider 214. Accordingly, the undivided header 208 may comprise a substantially vertically continuous undivided header volume 216.

The outdoor heat exchanger 114 may also comprise a plurality of microchannel tubes 220 that extend horizontally between the divided header 206 and the undivided header 208. The microchannel tubes 220 may generally be configured to join the divided header 206 and the undivided header 208 in fluid communication with each other. The outdoor heat exchanger 114 may also comprise a refrigerant inlet tube 226 in substantially direct fluid communication with the upper volume 210 of the divided header 206. The outdoor heat exchanger 114 may also comprise a refrigerant outlet tube 228 in substantially direct fluid communication with the lower volume 212 of the divided header 206.

The microchannel tubes 220 may be configured to join the divided header 206 and the undivided header 208 in fluid communication. The microchannel tubes 220 that supply refrigerant from the upper volume 210 of the divided header 206 to the undivided header 208 may generally be referred to as supply microchannel tubes 220', while the microchannel tubes 220 that supply refrigerant from the undivided header 208 to the lower volume 212 of the divided header 206 may be referred to as return microchannel tubes 220". In some embodiments, the supply microchannel tubes 220' and the return microchannel tubes 220" may comprise substantially the same length between the divided header 206 and the undivided header 208. It will be appreciated that the outdoor heat exchanger 114 may be described as comprising an upper region 230 that comprises the plurality of supply microchannel tubes 220' and a lower region 232 that comprises the plurality of return microchannel tubes 220". It will also be appreciated that the direction of flow of refrigerant from the upper volume 210 of the divided header 206 to the undivided header 208 through the supply microchannel tubes 220' and the flow of refrigerant from the undivided header 208 to the lower volume 212 of the divided header 206 through the return microchannel tubes 200" may generally be shown by refrigerant flow arrows 218.

Figure 3:
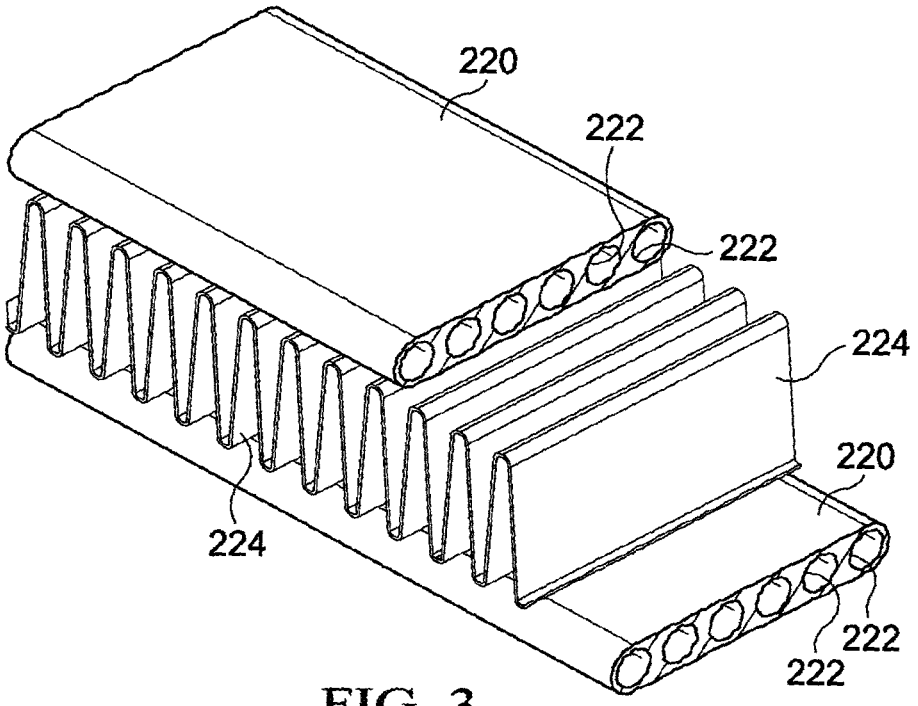
FIG. 3 is a partial cutaway oblique view of a plurality of microchannel tubes of the outdoor heat exchanger according to an embodiment of the disclosure.

Referring now to FIG. 3, a partial cutaway oblique view of a plurality of microchannel tubes 220 of the outdoor heat exchanger 114 is shown according to an embodiment of the disclosure. In some embodiments, each microchannel tube 220 may comprise a plurality of substantially parallel microchannels 222. The microchannels 222 may generally connect the divided header 206 in fluid communication with the undivided header 208. In some embodiments, the microchannel tubes 220 may comprise microchannels 222 that comprise substantially similar diameters. In some embodiments, the microchannel tubes 220 may also comprise a substantially similar number of microchannels 222. In embodiments where the microchannel tubes 220 comprise a substantially similar number of microchannels 222 having substantially similar diameters, it will be appreciated that each microchannel tube 220 may comprise substantially similar microchannel 222 volumes in each microchannel tube 220. Additionally, vertically adjacent microchannel tubes 220 may be joined to intermediately-disposed fins 224. In some embodiments, the intermediately-disposed fins 224 may be formed from a thermally-conductive material and configured to promote heat transfer between refrigerant flowing through the plurality of microchannel tubes 220 and an airflow passing through the outdoor heat exchanger 114 via the intermediately-disposed fins 224. It will be appreciated that the intermediately-disposed fins 224 are not shown in FIG. 1 for clarity.

Figure 4A:
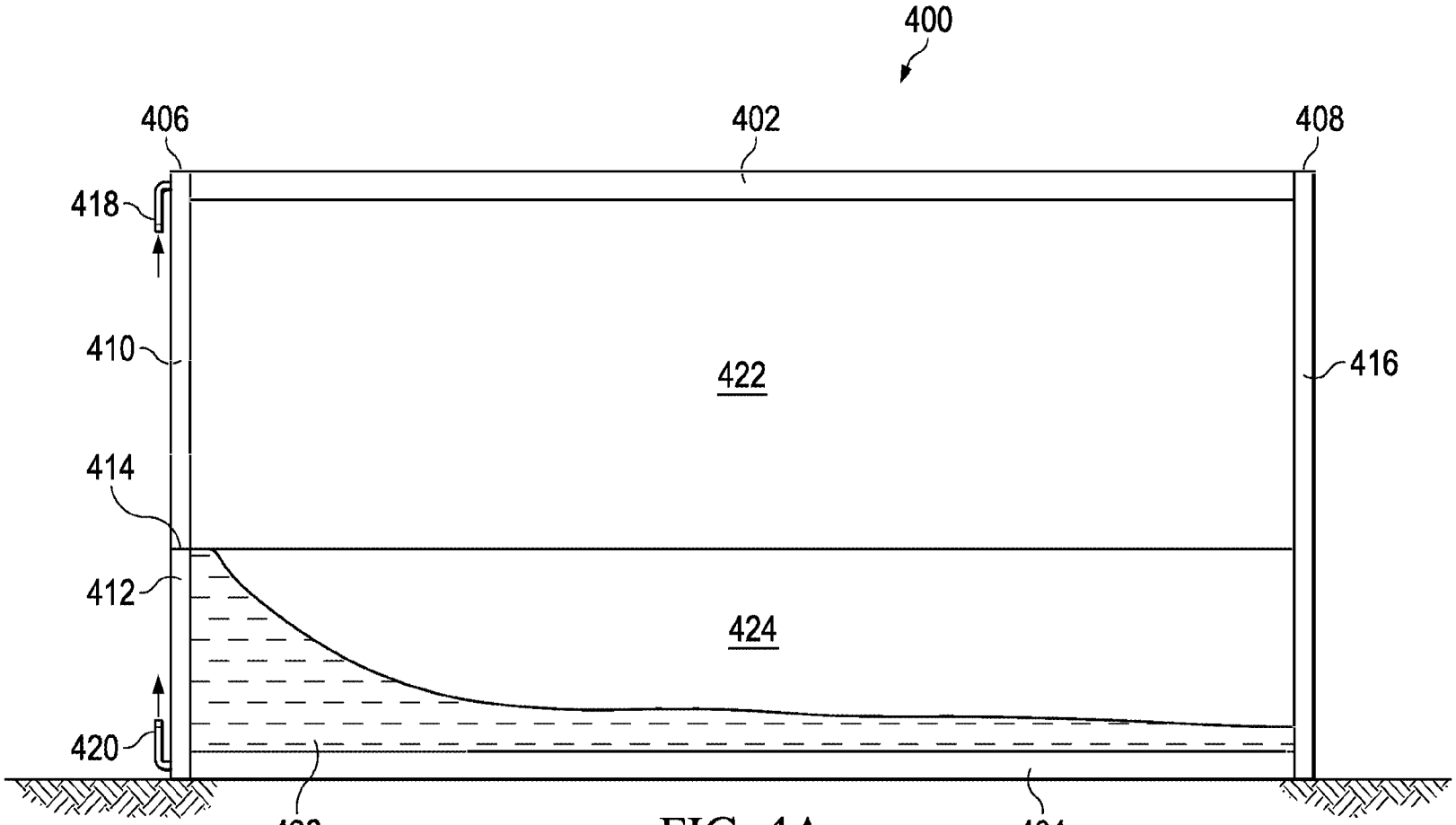
FIG. 4A is a schematic view of a conventional heat exchanger illustrating the behavior of liquid refrigerant in the conventional heat exchanger under normal steady state operating conditions.

Referring now to FIG. 4A, a schematic view of a conventional microchannel heat exchanger 400 illustrating the behavior of liquid refrigerant in the conventional microchannel heat exchanger 400 under normal steady state operating conditions is shown. Conventional microchannel heat exchanger 400 may generally comprise a microchannel heat exchanger and be described as similarly configured to outdoor heat exchanger 114 in that conventional microchannel heat exchanger 400 comprises an upper end 402, a lower end 404, a divided header 406, and an undivided header 408. The lower end 404 may generally be located vertically lower than the upper end 402. The divided header 406 may generally comprise a tubular structure that comprises an upper volume 410 and a lower volume 412. The upper volume 410 and the lower volume 412 may generally be separated and prevented from directly communicating fluid between each other by a divider 414 disposed within the divided header 406 between the upper volume 410 and the lower volume 412. The undivided header 408 may generally comprise a substantially similar tubular structure to that of the divided header 406. However, the undivided header 408 does not comprise an internal structure analogous to the divider 414. Accordingly, the undivided header 408 may comprise a substantially vertically continuous undivided header volume 416.

Although not shown, the conventional microchannel heat exchanger 400 may also comprise a plurality of microchannel tubes, microchannels, and fins that may be configured substantially similarly to the microchannel tubes 220, microchannels 222, and fins 224, respectively, of FIG. 3. The microchannel tubes may generally extend horizontally between the divided header 406 and the undivided header 408, thereby joining the divided header 406 and the undivided header 408 in fluid communication with each other. The conventional microchannel heat exchanger 400 may also comprise a refrigerant inlet tube 418 in substantially direct fluid communication with the upper volume 410 of the divided header 406. The conventional microchannel heat exchanger 400 may also comprise a refrigerant outlet tube 420 in substantially direct fluid communication with the lower volume 412 of the divided header 406.

The microchannel tubes may be configured to join the divided header 406 and the undivided header 408 in fluid communication. The microchannel tubes that supply refrigerant from the upper volume 410 of the divided header 406 to the undivided header 408 may generally be referred to as supply microchannel tubes, while the microchannel tubes that supply refrigerant from the undivided header 408 to the lower volume 412 of the divided header 406 may be referred to as return microchannel tubes. It will be appreciated that the conventional microchannel heat exchanger 400 may be described as comprising an upper region 422 that comprises the plurality of supply microchannel tubes and a lower region 424 that comprises the plurality of return microchannel tubes. Generally, the conventional microchannel heat exchanger 400 differs from the microchannel heat exchanger 114 in that the conventional microchannel heat exchanger 400 may comprise about 50 supply microchannel tubes in the upper region 422 and about 24 return microchannel tubes in the lower region 424. It may alternatively be stated that the conventional microchannel heat exchanger 400 may comprise a conventional microchannel tube configuration that is about ⅔ supply microchannel tubes and about ⅓ return microchannel tubes. Accordingly, the conventional microchannel heat exchanger 400 may comprise a ratio of supply microchannel tubes to return microchannel tubes that is about 2:1.

Under normal and/or ideal operating conditions in a cooling mode of operation, the conventional microchannel heat exchanger 400 may be generally described as comprising a refrigerant level that is correctly adjusted, i.e. a level that exists when the closed loop refrigerant system is neither substantially overcharged nor substantially undercharged. Because, under ideal and/or normal conditions, refrigerant is introduced into the conventional microchannel heat exchanger 400 as hot gas, the hot gas will normally fill the upper volume 410 of the divided header 406 and travel in parallel paths through the supply microchannel tubes of the upper region 422. As the hot gas is cooled by ambient outdoor air being forced into contact with the conventional microchannel heat exchanger 400, some of the hot gas may cool and condense into liquid form before exiting the conventional microchannel heat exchanger 400 through the refrigerant outlet tube 420. Generally, a substantial amount of such initial condensation and conversion to liquid form may occur in the upper region 422.

When the refrigerant exits the supply microchannel tubes of the upper region 422, it may be introduced into the undivided header 408 as a mixture of condensed liquid and uncondensed hot gas. When the condensed liquid refrigerant reaches the undivided header 408, the refrigerant that is in liquid form may fall into the bottom of the continuous undivided header volume 416 of the undivided header 408 and become distributed into the various return microchannel tubes of the lower region 424 of the conventional microchannel heat exchanger 400. While refrigerant passes through the return microchannel tubes of the lower region 424, more of the hot gas refrigerant may cool and condense into liquid form, while previously condensed liquid refrigerant may be further cooled. Under normal and/or ideal conditions, the lower region 424 may comprise a liquid refrigerant volume 426 that is substantially distributed across the lower region 424 as shown with the vertically lowest return microchannel tubes completely filling with liquid refrigerant before relatively higher return microchannel tubes.

Figure 4B:
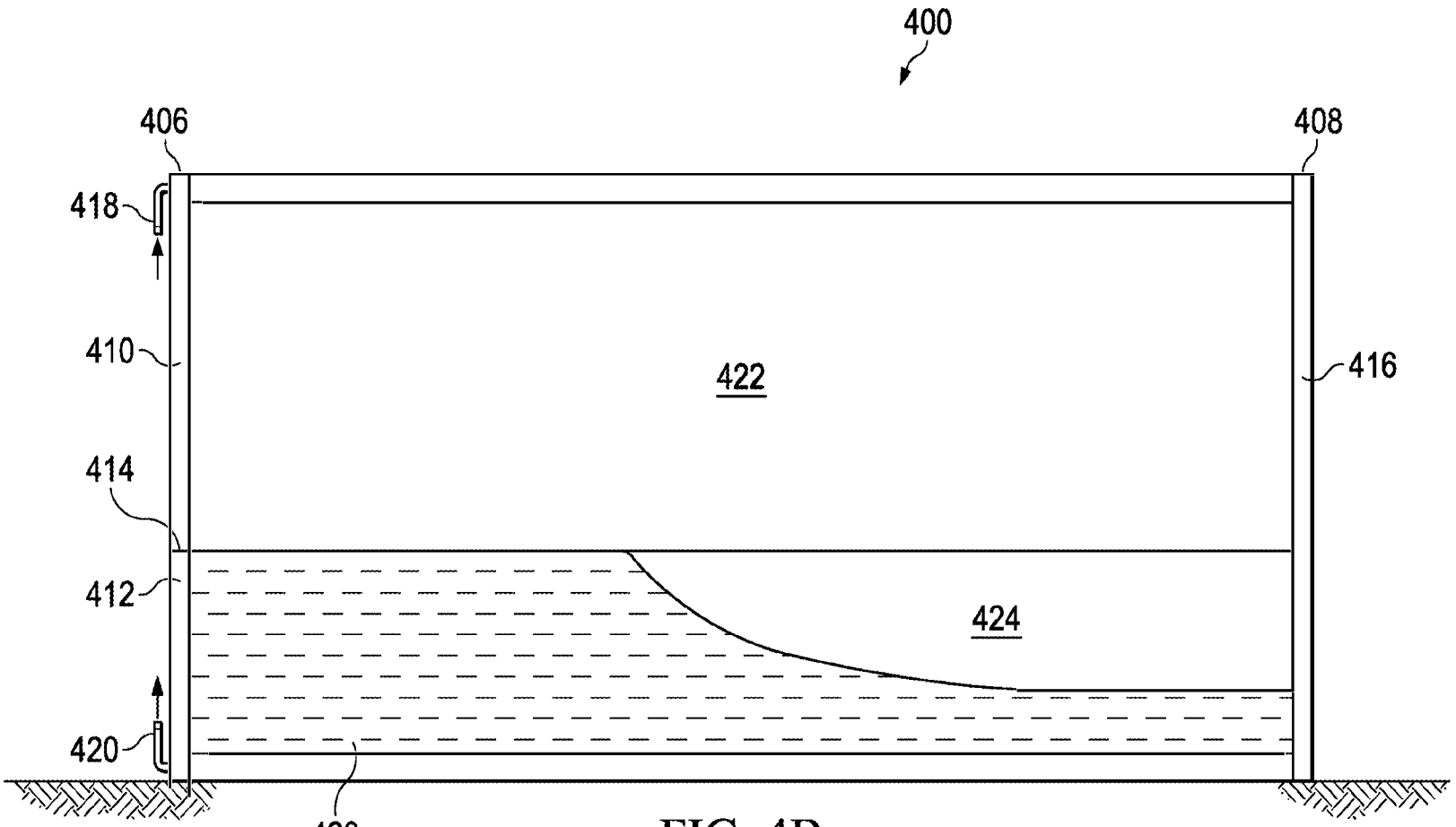
FIG. 4B is a schematic view of a conventional heat exchanger illustrating the behavior of liquid refrigerant in the conventional heat exchanger under abnormal steady state operating conditions.

Referring now to FIG. 4B, a schematic view of the conventional microchannel heat exchanger 400 illustrating the behavior of liquid refrigerant in the conventional microchannel heat exchanger 400 under abnormal steady state operating conditions is shown. As opposed to normal steady state operating conditions, abnormal steady state operating conditions may exist when either (1) an HVAC system is overcharged with too much refrigerant and is operating under normal and/or ideal ambient temperature conditions, (2) an HVAC system is properly charged but is operating under very high ambient temperature conditions, and/or (3) an HVAC system is both overcharged and is operating under very high ambient temperature conditions. Under such described abnormal steady state operating conditions, refrigerant behavior may be different. For example, in some instances, liquid refrigerant may back-up into the conventional microchannel heat exchanger 400 through the refrigerant outlet tube 420.

Because liquid refrigerant may back-up into the conventional microchannel heat exchanger 400 through the refrigerant outlet tube 420, some liquid refrigerant may enter the return microchannel tubes of the lower region 424. Liquid refrigerant in the lower region 424 may substantially decrease heat transfer and reduce the efficiency of the heat exchanger 400 because liquid refrigerant in the heat exchanger 400 may be 80-90% less efficient at transferring heat in the conventional microchannel heat exchanger 400 as compared to gaseous or mixed phase refrigerant. Additionally, as a result of some steady state operating conditions causing more condensation of gaseous refrigerant into liquid in the supply microchannel tubes of the upper region 422, a larger volume of liquid refrigerant may enter the undivided header 408, fall into the bottom of the continuous undivided header volume 416 of the undivided header 408, and become distributed into the various return microchannel tubes of the lower region 424 of the conventional microchannel heat exchanger 400. While refrigerant passes through the return microchannel tubes of the lower region 424, more of the hot gas refrigerant may cool and condense into liquid form, while previously condensed liquid refrigerant may be further cooled. Under such abnormal conditions, the lower region 424 may comprise an excess liquid refrigerant volume 428 that is distributed across the lower region 424 substantially as shown and that is substantially greater than the liquid refrigerant volume 426 shown in FIG. 4A.

Because rows of single phase liquid refrigerant may render portions of the conventional microchannel heat exchanger 400 relatively ineffective for heat transfer, the excess liquid refrigerant volume 428 may cause about ⅓ of the heat exchanger 400 to be rendered ineffective for heat transfer purposes under abnormal steady state operating conditions. Thus, the heat exchanger 400 may realize about a ⅓ reduction in efficiency. Additionally, when the excess liquid refrigerant volume 428 persists in the lower region 424 of the heat exchanger 400, the excess liquid refrigerant volume 428 may undesirably cause higher subcooling and/or higher compressor discharge pressures, which in some cases may ultimately cause a compressor, such as compressor 116, to shut off due to excessively high discharge pressure.

Figure 5A:
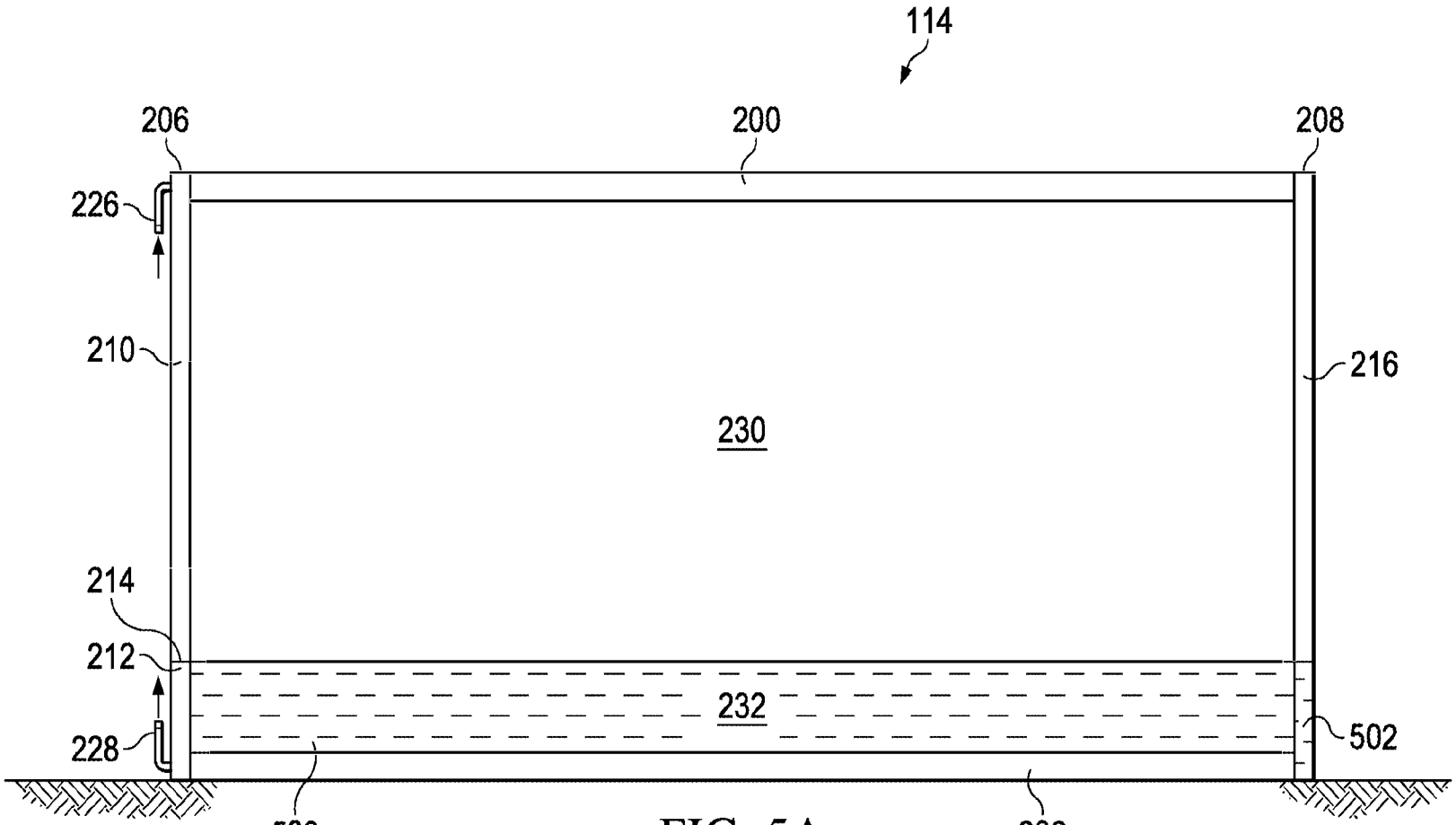
FIG. 5A is a schematic view of an outdoor heat exchanger illustrating the behavior of liquid refrigerant in the outdoor heat exchanger under normal steady state operating conditions according to an embodiment of the disclosure.

Referring now to FIG. 5A, a schematic view of the outdoor heat exchanger 114 illustrating the behavior of liquid refrigerant in the outdoor heat exchanger 114 under normal steady state operating conditions is shown according to an embodiment of the disclosure. As stated, outdoor heat exchanger 114 comprises an upper end 200, a lower end 202, a divided header 206 that comprises an upper volume 210 and a lower volume 212 that is divided by divider 214, an undivided header 208, an upper region 230 that comprises a plurality of supply microchannel tubes 220', and a lower region 232 that comprises a plurality of return microchannel tubes 220". It will be appreciated that the supply microchannel tubes 220' and the return microchannel tubes 220" are not shown for clarity. The outdoor heat exchanger 114 also comprises a refrigerant inlet tube 226 and a refrigerant outlet tube 228.

Figure 7:
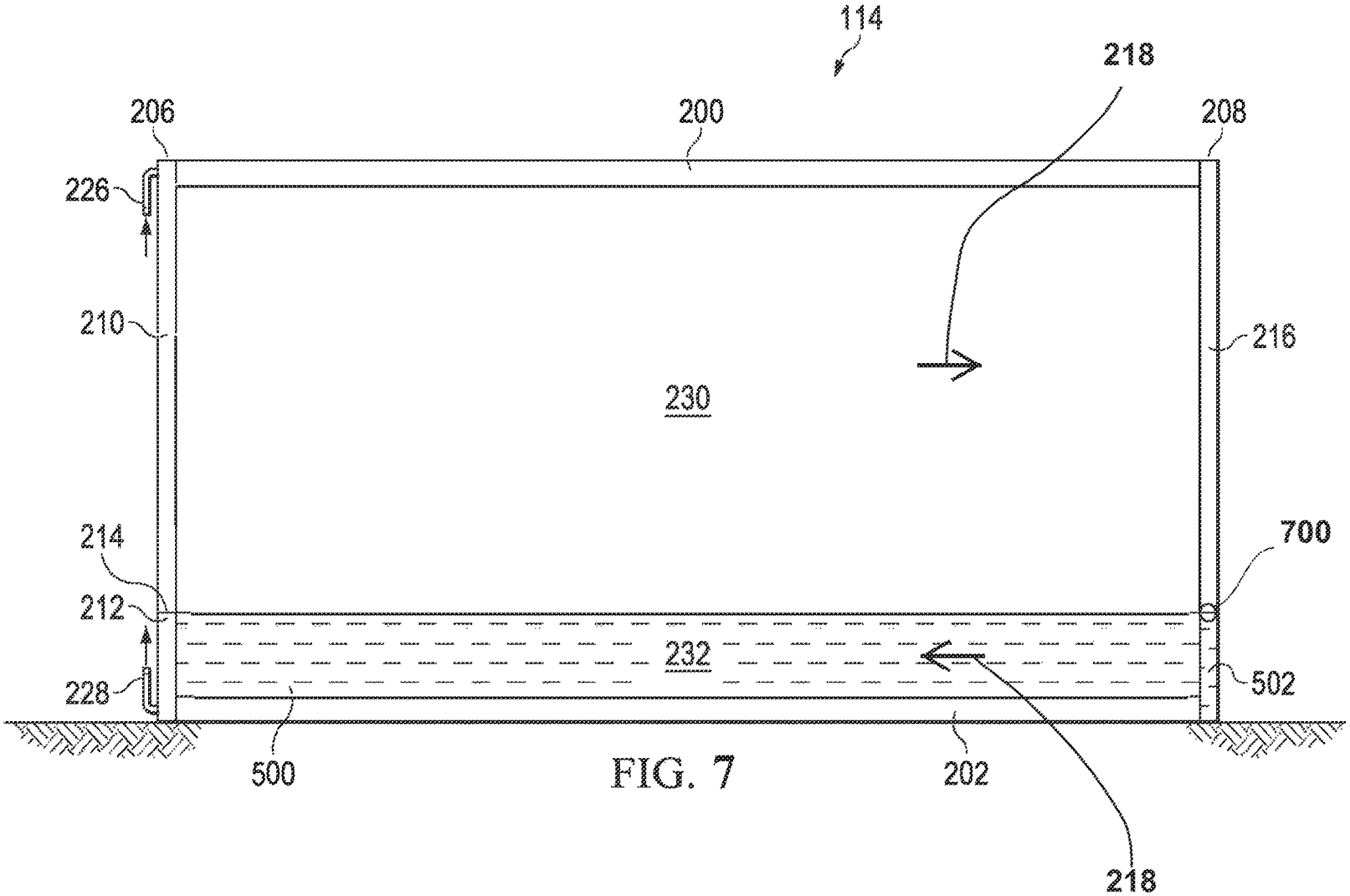
FIG. 7 is a schematic view of the outdoor heat exchanger of FIG. 5A including a sight glass according to an embodiment of the disclosure.

Under normal and/or ideal operating conditions, the outdoor heat exchanger 114 may generally be described as comprising a refrigerant level that is correctly adjusted, i.e. the closed loop refrigerant system of HVAC system 100 is neither substantially overcharged nor substantially undercharged. FIG. 7 illustrates some embodiments that can help with proper charging of the outdoor heat exchanger 114. Because, under ideal and/or normal conditions, refrigerant is introduced into the outdoor heat exchanger 114 as hot gas, the hot gas will normally fill the upper volume 210 of the divided header 206 and travel in parallel paths through the supply microchannel tubes 220' of the upper region 230. As the hot gas is cooled by ambient outdoor air being forced into contact with the outdoor heat exchanger 114, some of the hot gas may cool and condense into liquid form, resulting in the upper region 230 comprising some mixed-phase refrigerant. Generally, a substantial amount of such initial condensation and conversion to liquid form may occur in the upper region 230.

When the refrigerant exits the supply microchannel tubes 220' of the upper region 230, it may be introduced into the undivided header 208 as a mixture of condensed liquid and uncondensed hot gas. When the condensed liquid refrigerant reaches the undivided header 208, the refrigerant that is in liquid form may fall into the bottom of the continuous undivided header volume 216 of the undivided header 208 and become distributed into the various return microchannel tubes 220" of the lower region 232 of the outdoor heat exchanger 114.

Generally, as compared to the conventional microchannel heat exchanger 400 in FIGS. 4A-4B, the outdoor heat exchanger 114 may comprise a reduced number of return microchannel tubes 220" in the lower region 232 relative to the number of supply microchannel tubes 220' in the upper region 230 so that the supply microchannel tube to return microchannel tube ratio of the outdoor heat exchanger 114 is substantially greater than the supply microchannel tube to return microchannel tube ratio of the conventional microchannel heat exchanger 400. In some embodiments, outdoor heat exchanger 114 may comprise only those return microchannel tubes 220" necessary for subcooling. Accordingly, the plurality of return microchannel tubes 220" in the lower region 232 of outdoor heat exchanger 114 may be substantially filled by a liquid refrigerant volume 500. In some embodiments, reducing the number of return microchannel tubes 220" in the lower region 232 to only those necessary for subcooling may allow a substantially larger number of supply microchannel tubes 220' in the upper region 230 as opposed to the heat exchanger 400. Again, the outdoor heat exchanger 114 may comprise a higher ratio of supply microchannel tubes 220' in the upper region 230 to return microchannel tubes 220" in the lower region 232 as compared to heat exchanger 400. Most generally, this ratio may be greater than 2:1. In some embodiments, increasing the ratio of supply microchannel tubes 220' to return microchannel tubes 220" may provide an increase in efficiency over heat exchanger 400. In some embodiments, the increase in efficiency may be at least about 10%, at least about 15%, and/or at least about 20%.

In some embodiments, outdoor heat exchanger 114 may comprise a ratio of supply microchannel tubes 220' to return microchannel tubes 220" that is about 2.5:1, about 3:1, about 4:1, about 5:1, about 6:1, about 7:1, about 8:1, about 9:1, about 10:1, about 11:1, about 12:1, about 13:1, about 14:1, and/or about 15:1. For example, in embodiments where outdoor heat exchanger 114 comprises a ratio of supply microchannel tubes 220' to return microchannel tubes 220" that is 10:1, outdoor heat exchanger 114 may comprise about 60 supply microchannel tubes 220' and about 6 return microchannel tubes 220". Alternatively, in other embodiments where outdoor heat exchanger 114 comprises a ratio of supply microchannel tubes 220' to return microchannel tubes 220" that is about 10:1, outdoor heat exchanger 114 may comprise about 62 supply microchannel tubes 220' and about 6 return microchannel tubes 220". It will be appreciated that an outdoor heat exchanger 114 comprising a ratio of supply microchannel tubes 220' to return microchannel tubes 220" may assume substantially similar volumes through each of the microchannel tubes 220', 220".

Alternatively, in some embodiments, the supply microchannel tubes 220' and the return microchannel tubes 220" may be characterized and/or configured based on their respective microchannel 222 volumes. In such embodiments, the outdoor heat exchanger 114 may comprise substantially similar microchannel 222 volumes through each of the microchannel tubes 220', 220". Conversely, in some embodiments, the outdoor heat exchanger 114 may comprise supply microchannel tubes 220' and return microchannel tubes 220" having dissimilar microchannel 222 volumes. Thus, the outdoor heat exchanger 114 may be characterized by comprising a ratio of the microchannel 222 volume of the supply microchannel tubes 220' to the microchannel 222 volume of return microchannel tubes 220" that is about 2.5:1, about 3:1, about 4:1, about 5:1, about 6:1, about 7:1, about 8:1, about 9:1, about 10:1, about 11:1, about 12:1, about 13:1, about 14:1, and/or about 15:1.

In yet other embodiments, the outdoor heat exchanger 114 may be configured based on a frontal area of the upper region 230 to a frontal area of the lower region 232. The frontal areas of the regions 230, 232 may be characterized by the front-facing area that is configured to receive an airflow supplied by an outdoor fan, such as outdoor fan 118. The frontal area of the upper region 230 may be defined on top by the upper end 200, on bottom by the divider 214, on one side by the divided header 206, and on the opposing side by the undivided header 208. The frontal area of the lower region 232 may be defined on top by the divider 214, on bottom by the lower end 202, on one side by the divided header 206, and on the opposing side by the undivided header 208. Accordingly, in some embodiments, the outdoor heat exchanger 114 may be characterized by comprising a ratio of the frontal area of the upper region 230 to the frontal area of the lower region 232 that is about 2.5:1, about 3:1, about 4:1, about 5:1, about 6:1, about 7:1, about 8:1, about 9:1, about 10:1, about 11:1, about 12:1, about 13:1, about 14:1, and/or about 15:1.

In some embodiments, outdoor heat exchanger 114 may be configured such that a portion of the liquid refrigerant in the outdoor heat exchanger 114 may also occupy at least a portion of the continuous undivided header volume 216 of the undivided header 208. The portion of the liquid refrigerant in the outdoor heat exchanger 114 that occupies the undivided header volume 216 may be referred to as a normal liquid refrigerant header volume 502 that may, in some embodiments under normal steady state operating conditions, fill the undivided header volume 216 to a height that may be substantially about equal to a height of the divider 214 as measured from the lower end 202. In other embodiments, under normal steady state operating conditions, the normal liquid refrigerant header volume 502 may comprise a height that is slightly higher than the height of the divider 214 as measured from the lower end 202.

Figure 5B:
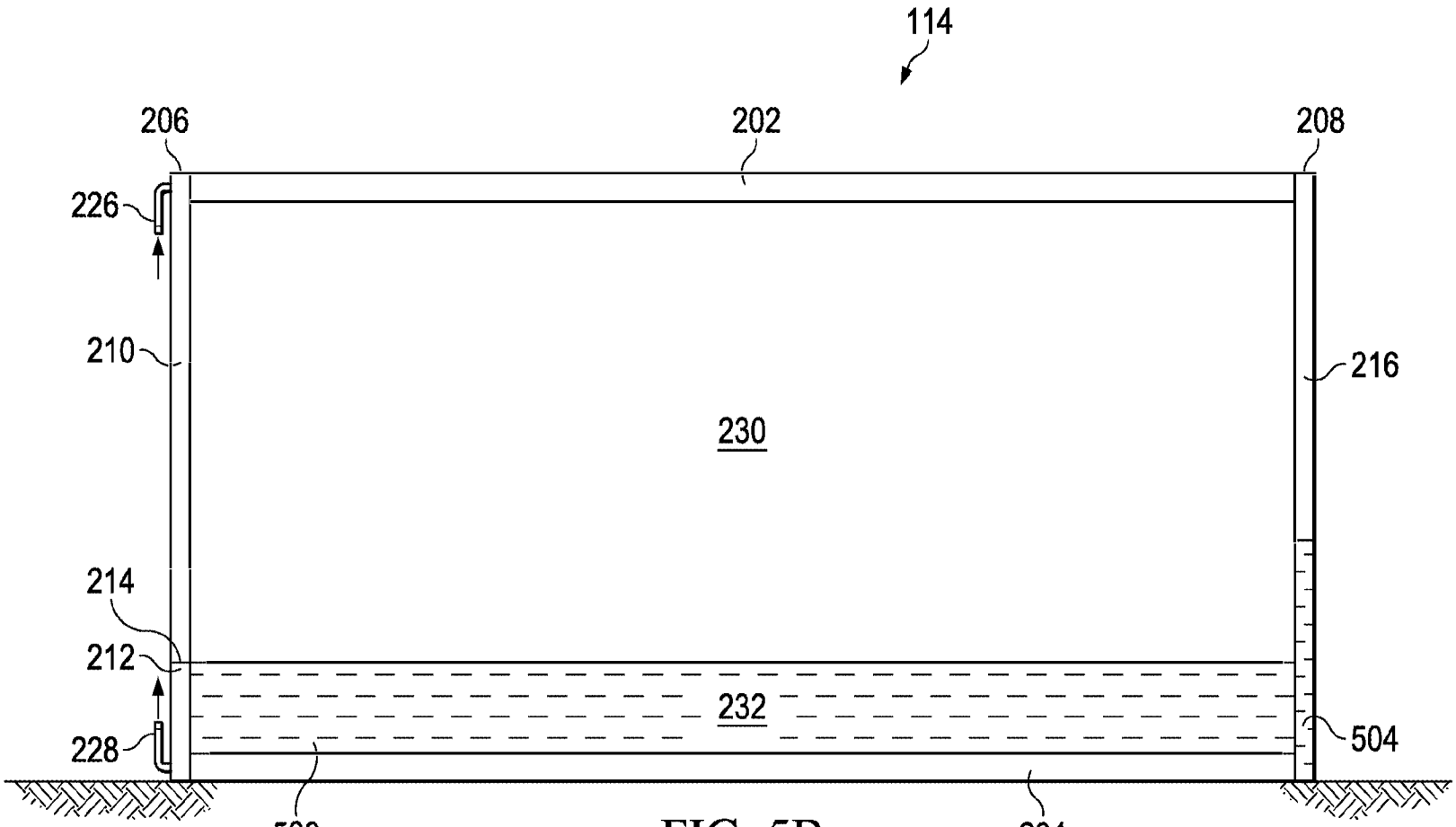
FIG. 5B is a schematic view of an outdoor heat exchanger illustrating the behavior of liquid refrigerant in the outdoor heat exchanger under abnormal steady state operating conditions according to an embodiment of the disclosure.

Referring now to FIG. 5B, a schematic view of an outdoor heat exchanger 114 illustrating the behavior of liquid refrigerant in the outdoor heat exchanger 114 under abnormal steady state operating conditions is shown according to an embodiment of the disclosure. As stated, abnormal steady state operating conditions may exist when either (1) the HVAC system 100 is overcharged with too much refrigerant and is operating under normal and/or ideal ambient temperature conditions, (2) the HVAC system 100 is properly charged but is operating under very high ambient temperature conditions, and/or (3) the HVAC system 100 is both overcharged and is operating under very high ambient temperature conditions. Under abnormal steady state operating conditions, the behavior of the refrigerant may vary. However, unlike the heat exchanger 400 in FIGS. 4A-4B where liquid refrigerant may back up into the heat exchanger 400 through the refrigerant outlet tube 420 and/or where excess liquid refrigerant may occupy a portion of the heat exchanger 400 optimized for gaseous and/or mixed phase refrigerant, outdoor heat exchanger 114 may generally be configured to receive excess liquid refrigerant (i.e. amounts of liquid refrigerant in excess of that which may accommodated by the return microchannel tubes 220" of the lower region 232) into the undivided header volume 216 of the undivided header 208.

The outdoor heat exchanger 114 comprises only those return microchannel tubes 220" necessary for subcooling under normal operating conditions at steady state such that the liquid refrigerant volume 500 substantially fills the return microchannel tubes 220" of the lower region 232. When the HVAC system 100 is overcharged and/or encounters high ambient temperature conditions, the amount of liquid refrigerant in the outdoor heat exchanger 114 may increase. In some embodiments, the undivided header 208 may comprise an undivided header volume 216 configured to receive a volume of refrigerant that is greater than the total volume of the microchannels 222 of the outdoor heat exchanger 114. In some embodiments, the undivided header 208 may comprise an undivided header volume 216 that is configured to receive about twice as much refrigerant as the microchannels 222 of the outdoor heat exchanger 114. Accordingly, the undivided header 208 of the outdoor heat exchanger 114 may be configured to receive the excess liquid refrigerant into the undivided header volume 216. The portion of the liquid refrigerant in the outdoor heat exchanger 114 that occupies the undivided header volume 216 under abnormal steady state operating condition may thus be referred to as an abnormal liquid refrigerant header volume 504. It will be appreciated that the abnormal liquid refrigerant header volume 504 caused by abnormal steady state operating conditions may generally be larger than the normal liquid refrigerant header volume 502 incurred under normal steady state operating conditions. Furthermore, in some embodiments, the abnormal liquid refrigerant header volume 504 may comprise a height that is substantially higher than the height of the divider 214 as measured from the lower end 202.

Since the excess liquid refrigerant in the outdoor heat exchanger 114 caused by abnormal steady state operating conditions may back up into the undivided header volume 216 of the undivided header 208, portions of the lower region optimized for two-phase refrigerant will not be displaced in the manner such occurs with heat exchanger 400. As such, even under abnormal steady state operating conditions, the outdoor heat exchanger 114 may provide an increase in efficiency over heat exchanger 400. In some embodiments, the increase in efficiency during abnormal conditions may be as high as about 10%, about 15%, and/or about 20%. In some embodiments, the outdoor heat exchanger 114 may maintain an overall efficiency even when the HVAC system 100 is overcharged or operating under excess ambient temperature conditions. Furthermore, because the undivided header 208 may have such a large volume of interior space as compared to the a sum interior space volumes of a group of and in some embodiments all of the microchannel tubes, the undivided header 208 may be configured to receive excess liquid refrigerant thereby reducing and/or eliminating a backup of liquid phase refrigerant into the upper region 230. Accordingly, in spite of the presence of undesirable increased amounts of liquid phase refrigerant, the outdoor heat exchanger 114 maintains a predetermined amount of utilization of the outdoor heat exchanger 114 for carrying gaseous and/or mixed phase refrigerant, thereby maintaining heat exchange efficiency levels and generally providing a higher charge tolerance as compared to other microchannel heat exchangers, such as conventional microchannel heat exchanger 400.

Figure 6:
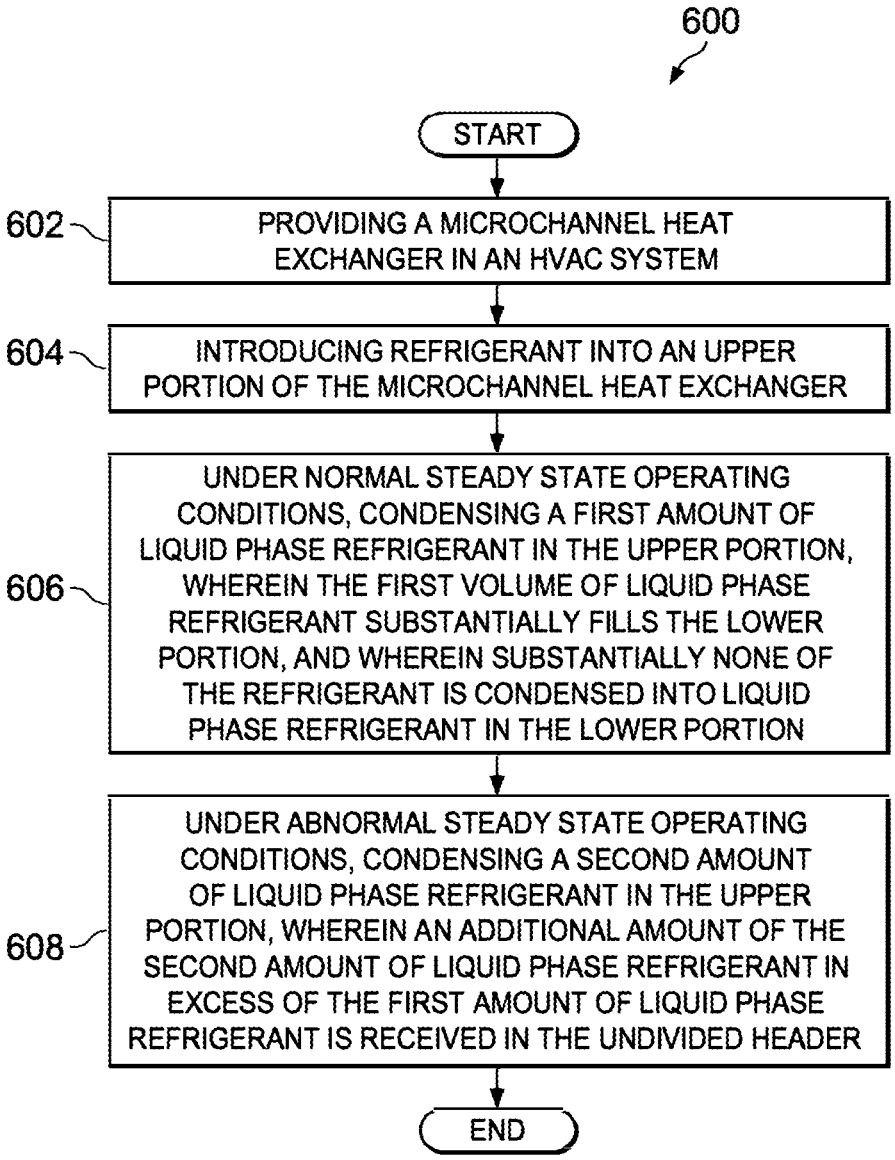
FIG. 6 is a flowchart of a method of operating a microchannel heat exchanger in an HVAC system according to an embodiment of the disclosure.

Referring now to FIG. 6, a flowchart of a method 600 of operating a microchannel heat exchanger in an HVAC system 100 is shown according to an embodiment of the disclosure. The method 600 may begin at block 602 by providing a microchannel heat exchanger in an HVAC system. In some embodiments, the microchannel heat exchanger may comprise outdoor heat exchanger 114. The method may continue at block 604 by introducing refrigerant into an upper portion of the microchannel heat exchanger. The method 600 may continue at block 606 by condensing a first amount of liquid phase refrigerant in the upper portion under normal steady state operating conditions, wherein the first volume of liquid phase refrigerant substantially fills the lower portion, and wherein substantially none of the refrigerant is condensed into liquid phase refrigerant in the lower portion. The method 600 may conclude at block 608 by condensing a second amount of liquid phase refrigerant in the upper portion under abnormal steady state operating conditions, wherein an additional amount of the second amount of liquid phase refrigerant in excess of the first amount of liquid phase refrigerant is accommodated in the undivided header as opposed to further filling the lower portion.

It will be appreciated that in the discussion above, relative volumes and amounts of refrigerant and the spaces occupied by the refrigerant are sometimes discussed as if the refrigerant were not constantly flowing throughout the closed loop refrigerant system. Such discussion is for illustration purposes only and this disclosure fully contemplates that the refrigerant buildup, pooling, presence, and generally behavior is dependent upon dynamic factors such as mass flow rates of the refrigerant, steady operation of HVAC system 100 components such as compressor 116, and other potentially transient factors.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, R1, and an upper limit, Ru, is disclosed, any number falling within the range is specifically disclosed. In particular, the following numbers within the range are specifically disclosed: R=R 1+k*(R u−R i), wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Unless otherwise stated, the term "about" shall mean plus or minus 10 percent of the subsequent value. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

Referring now to FIG. 7, a schematic view of the outdoor heat exchanger 114 of FIG. 5A including a sight glass 700 is shown, according to an embodiment of the disclosure. As previously described, the outdoor heat exchanger 114 comprises an upper end 200, a lower end 202, a divided header 206 that comprises an upper volume 210 and a lower volume 212 that is divided by divider 214, an undivided header 208, an upper region 230 that comprises a plurality of supply microchannel tubes 220' (see FIG. 2), and a lower region 232 that comprises a plurality of return microchannel tubes 220" (see FIG. 2). The illustrated outdoor heat exchanger 114 is representative of a two pass heat exchanger and includes the undivided header 208. In some embodiments, the outdoor heat exchanger 114 can be a heat exchanger including more than two passes. In such embodiments, both headers would include a divider dividing the header into a plurality of volumes. That is, embodiments in which the outdoor heat exchanger 114 includes more than two passes would include divided headers. It will be appreciated that the supply microchannel tubes 220' and the return microchannel tubes 220" are not shown in FIG. 7 for clarity. The outdoor heat exchanger 114 also comprises a refrigerant inlet tube 226 and a refrigerant outlet tube 228. A direction of flow of refrigerant from the upper volume 210 of the divided header 206 to the undivided header 208 through the supply microchannel tubes 220' and a flow of refrigerant from the undivided header 208 to the lower volume 212 of the divided header 206 through the return microchannel tubes 200" may generally be shown by refrigerant flow arrows 218.

In some embodiments, outdoor heat exchanger 114 may comprise only those return microchannel tubes 220" necessary for subcooling under normal operating conditions at steady state such that the liquid refrigerant volume 500 substantially fills the return microchannel tubes 220" of the lower region 232. In some embodiments, outdoor heat exchanger 114 may be configured such that a portion of the liquid refrigerant in the outdoor heat exchanger 114 may also occupy at least a portion of the continuous undivided header volume 216 of the undivided header 208. The portion of the liquid refrigerant in the outdoor heat exchanger 114 that occupies the undivided header volume 216 may be referred to as a normal liquid refrigerant header volume 502 that may, in some embodiments under normal steady state operating conditions, fill the undivided header volume 216 to a height that may be substantially about equal to a height of the divider 214 as measured from the lower end 202. In other embodiments, under normal steady state operating conditions, the normal liquid refrigerant header volume 502 may comprise a height that is slightly higher than the height of the divider 214 as measured from the lower end 202.

In some embodiments, the outdoor heat exchanger 114 also comprises a sight glass 700. It will be appreciated that the term "sight glass" (or "sightglass", or "water gauge", or the like) shall mean any transparent tube or window through which a refrigerant can be checked or observed visually. A sight glass can be made of any transparent material such as plastic or glass or the like. The sight glass 700 can serve as a visual aid in properly charging the HVAC system with refrigerant. By using the sight glass 700, a user can charge a unit (for example, the outdoor heat exchanger 114) by watching the sight glass 700 and adding (or removing) refrigerant until the user obtains a condition indicative that the refrigerant is at a specified (i.e. proper, or desired, or the like) level.

In some embodiments, the sight glass 700 can be located at a return portion of the outdoor heat exchanger 114. In some embodiments, the return portion of the outdoor heat exchanger 114 can be a location of a final pass in the outdoor heat exchanger 114. For example, in a two pass outdoor heat exchanger 114 (as shown in FIG. 7), the sight glass can be located on the undivided header 208. In some embodiments, the outdoor heat exchanger 114 can include more than two passes. In such embodiments, the sight glass 700 can be located on a return header at the turn leading to the final pass, prior to the outlet of the outdoor heat exchanger 114. In some embodiments, the sight glass 700 can be located on the undivided header 208. A user can view the sight glass 700 to see the normal liquid refrigerant header volume 502 under normal steady state operating conditions (or the abnormal liquid refrigerant header volume 504 of FIG. 5B under abnormal steady state operating conditions). In some embodiments, the sight glass 700 can be an indicator to represent a status of refrigerant in the HVAC system. In some embodiments, the sight glass 700 can be used by a user to check a status of refrigerant in the HVAC system. The status of refrigerant can be, for example, vapor, liquid, or mixed vapor and liquid. In some embodiments, when the indicator is clear, for example, when it appears that nothing can be observed through the sight glass, the indicator indicates that refrigerant is either vapor (for example, superheated vapor) or liquid (for example, subcooled liquid). When the indicator is unclear (e.g., visibly cloudy), the indicator indicates that refrigerant is mixed vapor and liquid. In some embodiments, the sight glass 700 can have a circle shape, a rectangular shape, a square shape, or any suitable shape. In some embodiments, the sight glass 700 can be used by the user to check whether a charge level of the HVAC system is correct. In some embodiments, when charging the unit (for example, the outdoor heat exchanger 114), a user can watch the sight glass 700. In some embodiments, the indicator is clear when beginning the charging process. The user can add refrigerant. The user can continue the charging process while the indicator is unclear. The user can stop the charging process when the indicator becomes clear again.

In some embodiments, the sight glass 700 may be disposed at a location at which refrigerant is expected to be a liquid, and therefore would be clear when viewed by the user. In some embodiments, the location at which the refrigerant is expected to be a liquid may be a location at which the refrigerant is expected to be a subcooled liquid. For example, in some embodiments, the sight glass 700 can be disposed at a location of a return portion of the outdoor heat exchanger 114. In some embodiments, the sight glass 700 (for example, the middle, or top edge, or bottom edge of the sight glass 700) can be aligned with a return microchannel tube 220" that is closest to a top of the lower region 232. In other embodiments, the sight glass 700 (for example, the middle, or top edge, or bottom edge of the sight glass 700) can be immediately above the return microchannel tube 220" that is closest to the top of the lower region 232. In some embodiments, the sight glass 700 (for example, the middle, or top edge, or bottom edge of the sight glass 700) can be one manifold diameter (for example, the diameter of the return microchannel tube 220") above the return microchannel tube 220" that is closest to the top of the lower region 232. In yet other embodiments, the sight glass 700 (for example, the middle, or top edge, or bottom edge of the sight glass 700) can be immediately below the return microchannel tube 220" that is closest to the top of the lower region 232. In some embodiments, the sight glass 700 (for example, the middle, or top edge, or bottom edge of the sight glass 700) can be two manifold diameters (for example, the diameter of the return microchannel tube 220") below the return microchannel tube 220" that is closest to the top of the lower region 232.

In some embodiments, the sight glass 700 (for example, the middle, or top edge, or bottom edge of the sight glass 700) can be aligned with a supply microchannel tube 220' that is closest to a bottom of the upper region 230. In other embodiments, the sight glass 700 (for example, the middle, or top edge, or bottom edge of the sight glass 700) can be immediately above the supply microchannel tube 220' that is closest to the bottom of the upper region 230. In yet other embodiments, the sight glass 700 (for example, the middle, or top edge, or bottom edge of the sight glass 700) can be immediately below the supply microchannel tube 220' that is closest to the bottom of the upper region 230.

In some embodiments, the sight glass 700 (for example, the middle, or top edge, or bottom edge of the sight glass 700) can be located between the supply microchannel tube 220' that is closest to a bottom of the upper region 230 and the return microchannel tube 220" that is closest to a top of the lower region 232. It will be appreciated that the alignments between sight glass 700 and the microchannel tubes are horizontal. In some embodiments, the middle of the sight glass 700 can be at or substantially about equal to the height of the divider 214. In other embodiments, the top edge or bottom edge of the sight glass 700 can be at or substantially about equal to the height of the divider 214. In some embodiments, a width of the sight glass 700 can be the same or substantially about equal to a width of the undivided header 208. In other embodiments, the width of the sight glass 700 can be smaller or larger than the width of the undivided header 208. It will be appreciated that instead of the sight glass 700, a sight-tube that is in parallel with the undivided header 208 (or in parallel with the divider 214) can be used as the visual aid.

In some embodiments, the location of the sight glass 700 is biased toward the bottom of the unit (for example, the outdoor heat exchanger 114). In some embodiments, the unit (for example, the outdoor heat exchanger 114) can be a two-pass heat exchanger. In other embodiments, the unit (for example, the outdoor heat exchanger 114) can be a heat exchanger with more than two passes. The location of the sight glass 700 is near the top of the bottom pass of the unit. In some embodiments, the sight glass 700 can be located at a return portion of the outdoor heat exchanger 114. In some embodiments, the return portion of the outdoor heat exchanger 114 can be a location of a final pass in the outdoor heat exchanger 114. For example, in a two pass outdoor heat exchanger 114 (as shown in FIG. 7), the sight glass can be located on the undivided header 208. In some embodiments, the outdoor heat exchanger 114 can include more than two passes. In such embodiments, the sight glass 700 can be located on a return header at the turn leading to the final pass prior to the outlet of the outdoor heat exchanger 114.

Aspects:

It is to be appreciated that any one of aspects 1-7 can be combined with any one of aspects 8-13.

Aspect 1. A microchannel heat exchanger, comprising:

a first portion connected in fluid communication with a header;

a second portion connected in fluid communication with the header at a location that is vertically lower on the header than the first portion; and a sight glass on the header to identify a charge level of refrigerant in the microchannel heat exchanger.

Aspect 2. The microchannel heat exchanger of aspect 1, wherein the sight glass is horizontally aligned with a top of the second portion.

Aspect 3. The microchannel heat exchanger of aspect 2, wherein the first portion comprises a first set of microchannel tubes and the second portion comprises a second set of microchannel tubes, and the sight glass is horizontally aligned with one of the second set of microchannel tubes that is closest to the top of the second portion.

Aspect 4. The microchannel heat exchanger of any one of aspects 1-3, wherein the first portion comprises a first frontal area and the second portion comprises a second frontal area, and the sight glass is horizontally aligned with a top of the second frontal area.

Aspect 5. The microchannel heat exchanger of any one of aspects 1-4, wherein the microchannel heat exchanger is an outdoor unit of an HVAC system.

Aspect 6. The microchannel heat exchanger of any one of aspects 1-5, wherein the sight glass is on the header at a final pass of the microchannel heat exchanger.

Aspect 7. The microchannel heat exchanger of any one of aspects 1-5, wherein the sight glass is on the header at a return portion of the microchannel heat exchanger.

Aspect 8. A method of charging a microchannel heat exchanger, comprising:

providing a microchannel heat exchanger in an HVAC system, the microchannel heat exchanger comprising an upper portion connected in fluid communication with a header, a lower portion connected in fluid communication with the header at a location that is vertically lower on the header than the upper portion, and a sight glass on the header for identifying a charge level of the microchannel heat exchanger; and introducing a refrigerant into the microchannel heat exchanger, the refrigerant being accommodated in the header; and charging the microchannel heat exchanger with the refrigerant to a predetermined level.

Aspect 9. The method of aspect 8, wherein charging the microchannel heat exchanger with the refrigerant to the predetermined level includes:

monitoring a level of refrigerant in the header through the sight glass.

Aspect 10. The method of aspects 8 or 9, wherein charging the microchannel heat exchanger with the refrigerant at the predetermined level further includes:

when an indicator of the sight glass is unclear, adding refrigerant into the microchannel heat exchanger.

Aspect 11. The method of any one of aspects 8-10, wherein charging the microchannel heat exchanger with the refrigerant at the predetermined level further includes:

when the indicator of the sight glass is clear, stopping adding refrigerant into the microchannel heat exchanger.

Aspect 12. The method of any one of aspects 8-11, wherein the sight glass is on the header at a final pass of the microchannel heat exchanger.

Aspect 13. The method of any one of aspects 8-11, wherein the sight glass is on the header at a return portion of the microchannel heat exchanger.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, indicate the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts, without departing from the scope of the present disclosure. The word "embodiment" as used within this specification may, but does not necessarily, refer to the same embodiment. This specification and the embodiments described are examples only. Other and further embodiments may be devised without departing from the basic scope thereof, with the true scope and spirit of the disclosure being indicated by the claims that follow.

The invention claimed is:

1. A method of charging a microchannel heat exchanger, comprising:

providing a microchannel heat exchanger in a heating, ventilation, and/or air conditioning (HVAC) system, the microchannel heat exchanger comprising an upper portion connected in fluid communication with a header, a lower portion connected in fluid communication with the header at a location that is vertically lower on the header than the upper portion, and a sight glass on the header for identifying a charge level of the microchannel heat exchanger; and introducing, by a user, a refrigerant into the microchannel heat exchanger, the refrigerant being accommodated in the header; and charging, by the user, the microchannel heat exchanger with the refrigerant to a predetermined level, wherein the sight glass is on the header at a return portion of the microchannel heat exchanger.

2. The method of claim 1, wherein charging the microchannel heat exchanger with the refrigerant to the predetermined level includes:

monitoring, by the user, a level of refrigerant in the header through the sight glass.

3. The method of claim 2, wherein charging the microchannel heat exchanger with the refrigerant at the predetermined level further includes:

when the sight glass is unclear, adding refrigerant into the microchannel heat exchanger.

4. The method of claim 2, wherein charging the microchannel heat exchanger with the refrigerant at the predetermined level further includes:

when the sight glass is clear, stopping adding refrigerant into the microchannel heat exchanger.

* * * * *